US010196807B2

(12) United States Patent
Kwong

(10) Patent No.: US 10,196,807 B2
(45) Date of Patent: Feb. 5, 2019

(54) SNAP-IN STRUCTURE OF ALUMINUM ALLOY WALLBOARD, ROOF PANEL, AND CORNER-CONNECTING MATERIALS

(71) Applicant: AluHouse Technology (GD) Company Limited, Guangdong (CN)

(72) Inventor: Hoi Fung Kwong, Guangdong (CN)

(73) Assignee: ALUHOUSE TECHNOLOGY (GD) COMPANY LIMITED, Guangdong (CN)

( * ) Notice: Subject to any disclaimer, the term of this patent is extended or adjusted under 35 U.S.C. 154(b) by 0 days.

(21) Appl. No.: 15/697,553

(22) Filed: Sep. 7, 2017

(65) Prior Publication Data

US 2018/0274221 A1 Sep. 27, 2018

(30) Foreign Application Priority Data

Mar. 24, 2017 (CN) ..... 2017 1 0184254

(51) Int. Cl.
*E04B 1/08* (2006.01)
*E04B 1/61* (2006.01)
*E04B 1/343* (2006.01)

(52) U.S. Cl.
CPC ..... *E04B 1/08* (2013.01); *E04B 1/34321* (2013.01); *E04B 1/34384* (2013.01); *E04B 1/6137* (2013.01); *E04B 1/6166* (2013.01); *E04B 2103/06* (2013.01)

(58) Field of Classification Search
CPC ..... E04B 1/08; E04B 1/6166; E04B 1/34384; E04B 1/34321; E04B 1/6137; E04B 2103/06
See application file for complete search history.

(56) References Cited

U.S. PATENT DOCUMENTS 5,181,353 A * 1/1993 Harrington, Jr. ..... E04B 1/12 52/309.9
5,640,816 A * 6/1997 Reiland ..... E04B 1/6116 160/135
6,658,808 B1 * 12/2003 Doherty ..... E04B 1/12 52/579
8,136,324 B2 * 3/2012 Browning ..... E04B 1/14 52/580
9,080,724 B2 * 7/2015 Sele ..... F17C 3/00

* cited by examiner

*Primary Examiner* — Phi D A
*Assistant Examiner* — Omar F Hijaz
(74) *Attorney, Agent, or Firm* — Alan D. Kamrath; Kamrath IP Lawfirm, P.A.

(57) ABSTRACT

In a snap-in structure of aluminum alloy roof, roof panel, and corner-connecting materials, a roof panel's splicing base is connected with a splicing depression bar and secured by screws. Meanwhile, its bulge is connected with a snap-in groove, and its clasp is hooked with the clasp on the support section. A roof's splicing base is connected with a splicing depression bar and secured by screws. At the same time, its bulge is connected with a snap-in groove. The first corner-connecting material has an acute angle shape. Its transverse splicing base is engaged with the roof panel's splicing depression bar, and its longitudinal splicing base is engaged with the roof's splicing depression bar. The second corner-connecting material's splicing depression bar is attached with a roof panel's splicing base. A combination of the insert spell buckle and screws fixes without using any sealing materials. It is waterproof and easy to install. It is primarily applied to install at an aluminum alloy house's wall and roof.

16 Claims, 3 Drawing Sheets

SNAP-IN STRUCTURE OF ALUMINUM ALLOY WALLBOARD, ROOF PANEL, AND CORNER-CONNECTING MATERIALS

BACKGROUND OF THE INVENTION

This invention relates to an aluminum alloy structural house in the architectural structure field and, especially, to a snap-in structure connecting aluminum alloy wallboard, roof panel, and corner-connecting materials.

In the architectural design, it is always better to have a larger span space with a non-vertical structure for various partition demands to present a diverse interior layout. In the traditional house, the flexibility of space arrangement is restricted by the characteristics of materials. The oversize division would thicken the floor slab and increase the beam-column section. It not only affects the beauty of the interior design, but also adds structure weight and raises construction investments. As the majority of wallboards cannot be removed or displaced, it is difficult to change the wallboards layout when people design and decorate their properties. The restriction of these wallboards not only increases people's financial burden, but also adds a potential safety hazard due to the broken bearing wall.

The present steel structure buildings with its heavy weight and its expensive material cost increase the basic fabrication cost, which cause the excessive project investment.

When installing the fixed thermal insulation and decorative materials in the conventional house, the fixtures are directly used to connect wallboards and roof panels. This method damages the wallboards and roof panels and shapes a connecting bridge, so the thermal insulation performance of the wallboard and roof board is weakened.

Therefore, technicians in this field aim to research and develop a kind of aluminum alloy connection structure system, joining roofing and walls. Their components can be manufactured in the factories, and can then be shipped to work sites for whole assembly. It can also improve the system structure of an aluminium alloy house.

BRIEF SUMMARY OF THE INVENTION

This invention provides a set of a snap-in structure connecting aluminum alloy wallboard, roof panel, and corner-connecting materials. It solves the problem that the current steel structure buildings have heavy weight, high material costs, low wallboard thermal insulation performance and connecting problems with aluminum alloy wallboard, roof panel and corner-connecting materials.

The technical solution of the invention is as follows:

A snap-in structure of aluminum alloy wallboard, roof panel, and corner-connecting materials includes several single aluminum alloy wallboards, several single aluminum alloy roof panels, the first corner-connecting materials, the second corner-connecting materials, and the retaining screws.

The roof panel's support section is provided on the upper side of the roof panel's splicing base on one end of an aluminum alloy roof panel. The roof panel's snap-in groove is provided on the lower side of the roof panel's splicing base. The roof panel's bulge is provided on the top side of the roof panel's splicing depression bar on the other side of the aluminum alloy roof panel. The roof panel's clasp is provided on the upper side of the roof panel's splicing depression bar. The roof panel's splicing base is engaged with the roof panel's splicing depression bar. The roof panel's splicing depression bar is attached with the roof panel's splicing base and is connected by a retaining screw while the roof panel's bulge is clasped with the roof panel's snap-in groove and while the roof panel's clasp is hooked with the roof panel's support section.

A wallboard snap-in groove is provided on the upper side of the wallboard's splicing base on one end of a single aluminum alloy wallboard, and a wallboard bugle is provided above the wallboard splicing depression bar on the other end of the single aluminum alloy wallboard. The single wallboard splicing base is mated with another single wallboard splicing depression bar, which is connected with the wallboard splicing base by the retaining screw while the wallboard bulge is engaged with the wallboard snap-in groove.

The first corner-connecting material has an acute angle shape. The connected material's snap-in groove is provided on the upper side of the first corner-connecting material's transverse splicing base on the right end of the first corner-connecting material. The first corner-connecting material's bulge is provided on the lower side of the first corner-connecting material's longitudinal splicing base on the lower end of the first corner-connecting material. The first corner-connecting material's link groove is provided on the left end of the first corner-connecting material. The first corner-connecting material's transverse splicing base of the first corner-connecting material is engaged with the single roof panel's splicing depression bar. The roof panel's splicing depression bar is attached to the first corner-connecting material's transverse splicing base and is connected by a retaining screw while the connected material's snap-in groove is hooked with the roof panel's clasp. The first corner-connecting material's longitudinal splicing base is engaged with the wallboard splicing depression bar. The wallboard splicing depression bar is attached to the first corner-connecting material's longitudinal splicing base and is connected by a retaining screw while the first corner-connecting material's bulge is engaged with the wallboard bulge.

The second corner-connecting material has an acute angle shape. The second corner-connecting material's bulge is provided on the upper side of the second corner-connecting material's splicing depression bar on the left end of the second corner-connecting material. The second corner-connecting material's clasp is provided on the upper side of the second corner-connecting material's splicing depression bar. The second corner-connecting material's snap-in groove is provided on the lower side of the second corner-connecting material's splicing base on the lower end of the second corner-connecting material, and the second corner-connecting material's link groove is provided on the right end of the second corner-connecting material. The second corner-connecting material's splicing depression bar of the second corner-connecting material is engaged with the roof panel's splicing base. The second corner-connecting material's splicing depression bar is attached to the roof panel's splicing base and is connected by a retaining screw, while the second corner-connecting material's bulge is engaged with the roof panel's snap-in groove and while the second corner-connecting material's clasp is clasped with the roof panel's support section.

The snap-in structure of the aluminum alloy wallboard, the roof panel, and the corner-connecting materials also includes an aluminum alloys surface eave, and the aluminum alloy surface eave has a connecting upper arm and a lower arm at one end. The clasp is located at the end of the surface eave between the upper arm and the lower arm.

There are C-shape mounting notches at the bottom of the aluminum alloy surface eave.

When the aluminum alloy surface eave connects with the first corner-connecting materials, the surface eave's clasp and the first corner-connecting groove are an interlocking hook and butt joint.

When the aluminum alloy surface eave connects with the second corner-connecting materials, the surface eave's clasp and the second corner-connecting groove are an interlocking hook and butt joint.

The interior of a single aluminum alloy roof panel has relative oblique support ribs.

The interior of a single aluminum alloy wallboard has relative oblique support ribs.

The C-shape mounting notch installed at the bottom of the single aluminum alloy roof panel is convenient to assemble to other items.

The C-shape mounting notch installed on the single aluminum alloy wallboard is convenient to assemble to other items.

This invention is a snap-in structure of an aluminum alloy wallboard, a roof panel, and corner-connecting materials. Mounting and connecting structure is settled at the aluminum alloy wallboard, the roof panel, and the corner-connecting materials, and a concave-convex-shaped groove is fit at the connection point. The connections of the aluminum alloy wallboard, the roof panel, and the corner-connecting materials inlay with each other and are fixed with a screw fastener, so that the connection is more secure and safe. The connecting structure of the aluminum alloy wallboard, the roof panel, and the corner-connecting materials has better bending resistance, torsion resistance, impact resistance, and overall stability. It reduces or even eliminates the usage of pillar and ring beams and increases room space utilization. The designed aluminum surface eave improves the wall's waterproofing quality and enhances the beauty of the house. As the special connecting structure with the aluminum wallboard, the roof panel and the corner-connecting materials is water resistant, it is not necessary to use waterproof sealed materials at the connection point.

This invention with the snap-in structure connecting the aluminum wallboard, the roof panel, and the corner-connecting materials is primarily applied to install at the aluminum alloy house's wall and roof. Aluminum profiles wallboard, the roof panel, and the corner-connecting materials are designed as a combination of compact insert-split clasp joint and retaining screws. Under the circumstance that no sealing materials are used, it is waterproof and easy to install.

The advantages of this invention with the snap-in structure connecting aluminum wallboard, roof panel, and corner-connecting materials are as follows:

1. The wallboard and roof panel have a special designed structure. Due to the unique cross-sectional design, it has relatively better bending resistance, torsional resistance, and impact resistance, so the house has the advantages of large wind load, no deformation, and integral stability. Compared with conventional designs, it decreases or even eliminates the usage of pillar and ring beams.

When installing the fixed thermal insulation and decorative materials in the conventional house, the fixtures are directly used to connect the wallboards and the roof panels. This method damages the wallboards and roof panels and shapes a connecting bridge, so that the thermal insulation performances of the wallboard and the roof board are weakened. The designed C-shape mounting notch can effectively avoid the damage towards the wallboards and the roof panel caused by internal fixation. The potholder mat between the built-in fitment and the contact surface of the wallboards and the roof panel creates a cutting bridge to improve the wallboards and the roof panel thermal insulation performance.

The lighting, decorative lamp band, and buckle cover can be installed into the C-shape mounting notch of the aluminum surface eave. The dripping edge settled on the aluminum surface eave prevents rain flow into the C-shape mounting notch and onto the wallboards.

2. It has good rainfall resistance. The surface of aluminum profile materials is very smooth and flat. In addition, as all the assembly pieces are machined in the factories, the splice points are assured to be neat and tight. All the wallboards, roof panels, and corner-connecting materials are seamlessly secured and fastened by screws. Therefore, rainwater would not leak through the gap and wet the aluminum house.

3. It is convenient in assembly. It is easy to connect the aluminum wallboard, the roof panel, and the corner-connecting materials in order to avoid that the construction process, such as a welding process, is difficult and that the quality is hard to guarantee.

4. It has a low using cost. The surfaces of the aluminum alloy profile wallboard, the roof panel and the corner-connecting materials have already been anodized in order to form a stiff protective covering on the surface, to improve corrosion resistance, to increase abrasion resistance and hardness, and to protect the metal surface. It gradually reduces the maintenance cost.

5. The aluminum alloy wallboard, the roof panel and the corner-connecting materials are made by an aluminum alloy profile, so it can be recycled and melted after they are disassembled and discarded as useless. There reuse value can reach over 80% of its raw material value.

6. The production and installation technology are environmental friendly. All the aluminum wallboard, the roof panel, and the corner-connecting materials are machined in the factories. After being accurately assembled in advance, they are sent to the work site. Therefore, it is not necessary to cut the board or to drill holes to produce wastage or noise during clipping. The working site would be safe, clean and garbage-free.

7. It reduces carbon emission. All the raw materials of the aluminum alloy type building materials are from recyclable aluminum alloy materials. It conforms to the national regulation about energy saving, environmental protection, and low carbon emission for construction projects.

DESCRIPTION OF THE DRAWINGS

The illustrative embodiments may be best described by reference to the accompanying drawings where.

ATTACHED PICTURE MARK

Figure 1:
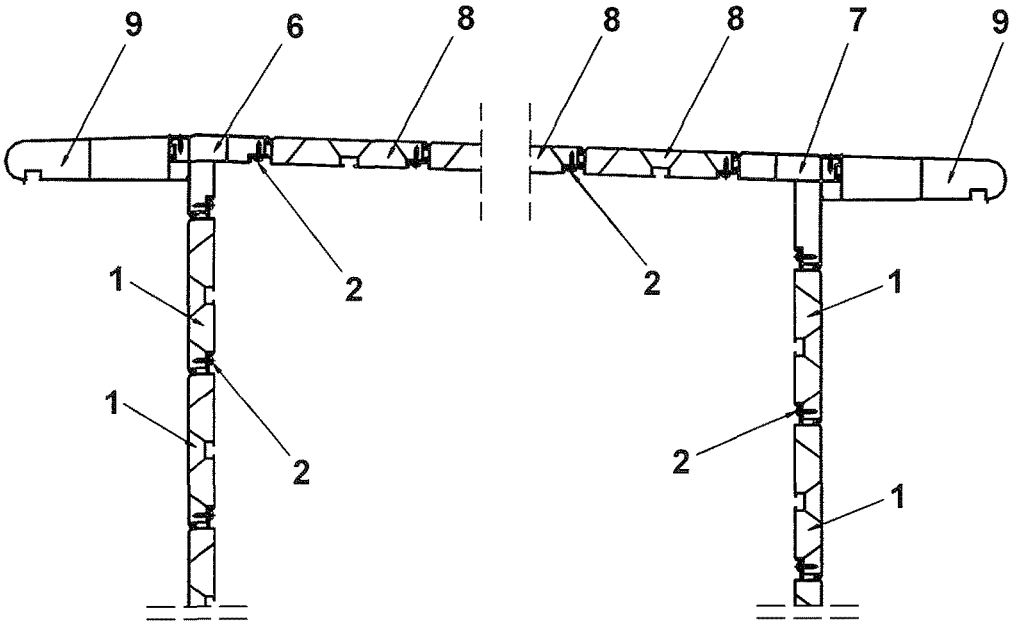
FIG. 1 is the schematic diagram for a snap-in structure connecting an aluminum alloy wallboard, a roof panel, corner-connecting materials, and aluminum alloy surface eaves.

1 is aluminum alloy wallboard, 2 is retaining screw, 6 is the first corner-connecting material, 7 is the second corner-connecting material, 8 is aluminum alloy roof panel, 9 is aluminum alloy surface eave.

11 is wallboard splicing base, 12 is wallboard splicing depression bar, 13 is wallboard bulge, 14 is wallboard snap-in groove, 15 is support rib, 16 is wallboard C-shape mounting notch.

61 is the first corner-connecting material's transverse splicing base, 62 is the first corner-connecting material's snap-in groove, 63 is the first corner-connecting material's longitudinal splicing base, 64 is the first corner-connecting material's bulge, 65 the first corner-connecting material's link groove.

71 is the second corner-connecting material's splicing base, 72 is the second corner-connecting material's snap-in groove, 73 is the second corner-connecting material's splicing depression bar, 74 is the second corner-connecting material's bulge, 75 is the second corner-connecting material's clasp, 76 the second corner-connecting material's link groove.

81 is roof panel's splicing base, 82 is roof panel's splicing depression bar, 83 is roof panel's bulge, 84 is roof panel's snap-in groove, 85 is roof panel's support section, 86 is roof panel's clasp, 87 is roof panel's C-shape mounting notch, 88 is support rib.

91 is aluminum alloy surface eaves upper arm, 92 is aluminum alloy surface eaves lower arm, 93 is aluminum alloy surface eave's clasp, 94 is aluminum alloy surface eave's C-shape mounting notch.

All figures are drawn for ease of explanation of the basic teachings only; the extensions of the figures with respect to number, position, relationship, and dimensions of the parts to form the illustrative embodiments will be explained or will be within the skill of the art after the following teachings have been read and understood. Further, the exact dimensions and dimensional proportions to conform to specific force, weight, strength, and similar requirements will likewise be within the skill of the art after the following teachings have been read and understood.

Where used in the various figures of the drawings, the same numerals designate the same or similar parts. Furthermore, when the terms "first", "second", "third", "fourth", "bottom", "side", "end", "portion", "section", "spacing", "length", "depth", "thickness", and similar terms are used herein, it should be understood that these terms have reference only to the structure shown in the drawings as it would appear to a person viewing the drawings and are utilized only to facilitate describing the illustrative embodiments.

DETAILED DESCRIPTION OF THE INVENTION

Following is the detailed demonstration by the combination of attached figures and application cases.

Please refer to FIG. 1. A snap-in structure connecting an aluminum alloy wallboard, a roof panel, and corner-connecting materials includes several aluminum alloy wallboards 1, aluminum alloy roof panels 8, first corner-connecting materials 6, second corner-connecting materials 7, aluminum alloy surface eaves 9, and retaining screws 2.

Figure 2:
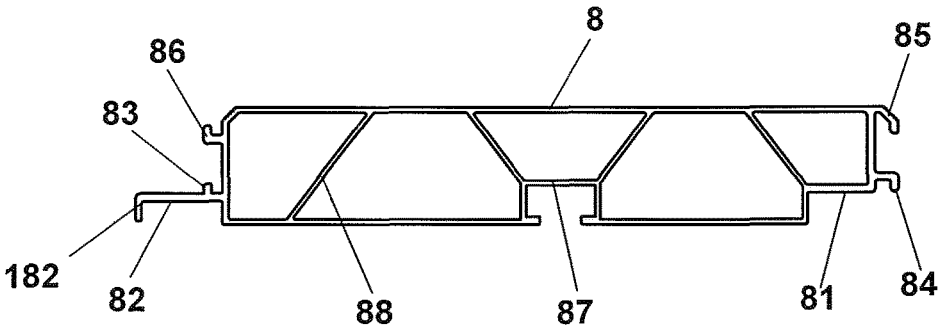
FIG. 2 is the cross section diagram of the aluminum alloy roof panel in FIG. 1.

Please refer to FIG. 2 and FIG. 1. At one side of aluminum alloy roof panel 8, a roof panel's support section 85 is installed on the lateral upper side of a roof panel's splicing base 81, and a roof panel's snap-in groove 84 is settled at the lateral inferior side of the roof panel's slicing base 81. On the other side of aluminum alloy roof panel 8, a roof panel's bulge 83 is set up on the roof panel's splicing depression bar 82, and a clasp 182 is installed at the lower side of the roof panel's splicing depression bar 82. A roof panel's slicing base 81 is symmetrically connected with another roof panel's splicing depression bar 82 and joint together, pressing the roof panel's splicing depression bar 82 on the roof panel's splicing seat 81 and connected by a retaining screw 2. At the same time, a roof panel's bulge 83 clasped with the roof panel's snap-in groove 84, and a roof panel's clasp 86 is clasped with the roof panel's support section 85.

Figure 3:
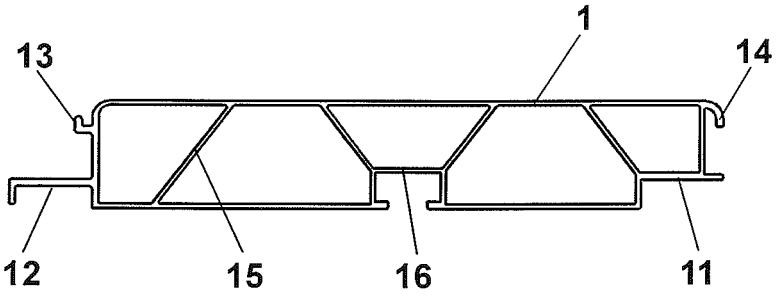
FIG. 3 is the cross section diagram of the aluminum alloy wallboard in FIG. 1.

Please refer to FIG. 3 and FIG. 1. A wallboard snap-in groove 14 is provided on the upper side of the wallboard splicing base 11 on one end of an aluminum alloy wallboard, and a wallboard bugle 13 is provided above the wallboard splicing depression bar 12 at the other end of the single aluminum alloy wallboard. The single wallboard splicing base 11 is mated with another single wallboard splicing depression bar 12, which is connected with the wallboard splicing base 11 by the retaining screw 2 while the wallboard bulge 13 is engaged with the wallboard snap-in groove 14.

Please refer to FIG. 4 and FIGS. 1 to 3. The first-connecting material 6 has an acute angle shape. The first corner-connecting material's snap-in groove 62 is provided on the upper side of the first corner-connecting material's transverse splicing base 61 on the right end of the first corner-connecting material 6, and the first corner-connecting material's bulge 64 is provided on the lower side of the first corner-connecting material's longitudinal splicing base 63 on the lower end of the first corner-connecting material 6. The first corner-connecting material's link groove 65 is provided on the left end of the first corner-connecting material 6. The first corner-connecting material's transverse splicing base 61 is engaged with a single roof panel's splicing depression bar 82, so that the roof panel's splicing depression bar 82 is attached to the first corner-connecting material's transverse splicing base 61 and is connected by the retaining screw 2 while the first corner-connecting material's snap-in groove 62 is hooked with the roof panel's clasp 86. The first corner-connecting material's longitudinal splicing base 63 is engaged with the wallboard splicing depression bar 12. The wallboard splicing depression bar 12 is attached to the first corner-connecting material's longitudinal splicing base 63 and is connected by the retaining screw 2, while the first corner-connecting material's bulge 64 is engaged with the wallboard bulge 13. Thus, it forms a solid connection situation.

Please refer to FIG. 5 and FIGS. 1 to 3. The second corner-connecting material 7 has an acute angle shape. The second corner-connecting material's bulge 74 is provided on the upper side of the second corner-connecting material's splicing depression bar 73 on the left end of the second corner-connecting material 7, and the second corner-connecting material's clasp 75 is provided on the upper side of the second corner-connecting material's splicing depression bar 73. The second corner-connecting material's snap-in groove 72 is provided on the lower side of the second corner-connecting material's splicing base 71 on the lower end of the second corner-connecting material 7, and the second corner-connecting material's link groove 76 is provided on the right end of the second corner-connecting material 7. The second corner-connecting material's splicing depression bar 73 of the second corner-connecting material 7 is engaged with the roof panel's splicing base 81, so that the the second corner-connecting material's splicing depression bar 73 is attached to the roof panel's splicing base 81 and is connected by the retaining screw 2, while the second corner-connecting material's bulge 74 is engaged with the roof panel's snap-in groove 84 and while the second corner-connecting material's clasp 75 is clasped with the roof panel's support section 85. Thus, it forms a solid connection situation.

Figure 6:
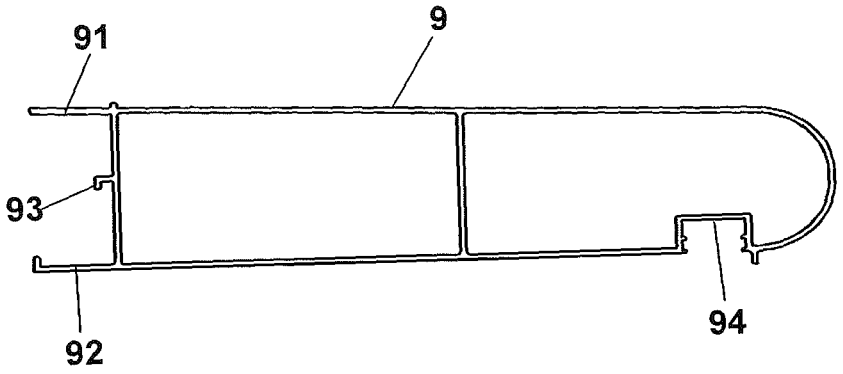
FIG. 6 is the cross section diagram of the aluminum alloy surface eaves in FIG. 1.

Please refer to FIG. 6. An aluminum alloy surface eave's upper arm 91 and an aluminum alloy surface eave's lower arm 92 are provided on the one end of aluminum alloy surface eave 9. An aluminum alloy surface eave's clasp 93 is provided on the top end of the aluminum alloy surface eave's upper arm 91 and the aluminum alloy surface eave's lower arm 92. An aluminum alloy surface eave's C-shape mounting notch 94 is provided on the bottom side of the aluminum alloy surface eave 9, and it can be used to place lighting or decorative lights and also can be installed with a decorative buckle. The aluminum alloy surface eave can prevent the rain from flowing into the C-shape notch and the wall by setting a dropping-edge.

Figure 4:
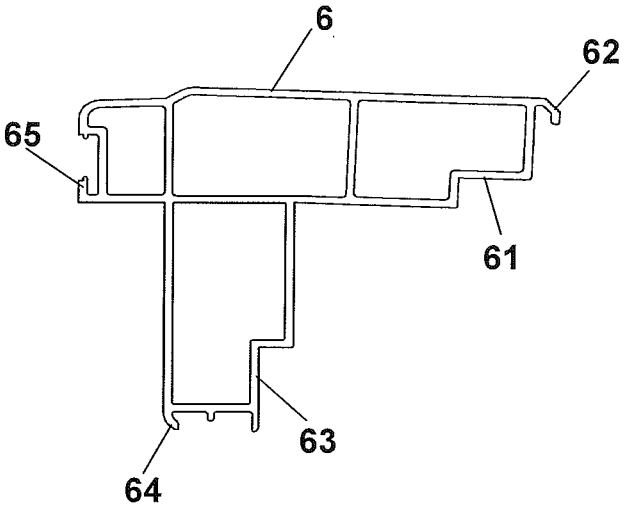
FIG. 4 is the cross section diagram of the first corner-connecting materials in FIG. 1.

Please refer to FIG. 4 and FIG. 1. The aluminum alloy surface eave 9 is connected with the first corner-connecting material 6, while the aluminum alloy surface eave's clasp 93 is clasped with the first corner-connecting material's link groove 65 at the same time.

Figure 5:
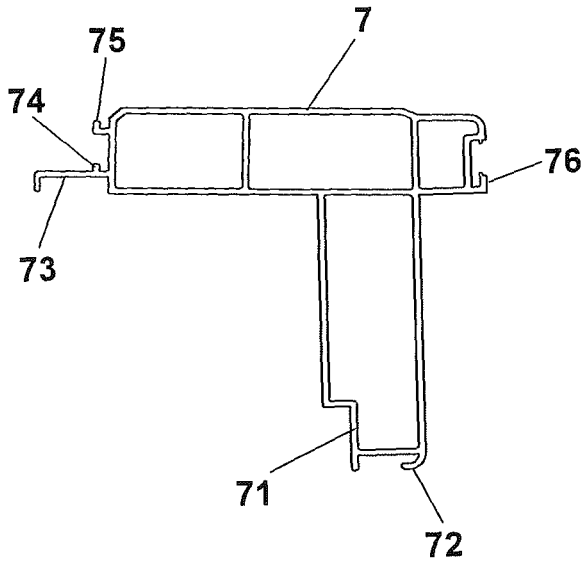
FIG. 5 is the cross section diagram of the second corner-connecting materials in FIG. 1.

Please refer to FIG. 5 and FIG. 1. The aluminum alloy surface eave 9 is connected with the second corner-connecting material 7, while the aluminum alloy surface eave's clasp 93 is clasped with the second corner-connecting material's link groove 76 at the same time.

As shown in FIG. 2, several relative oblique support ribs 88 are provided on the inside of the aluminum alloy roof panel 8. As shown in FIG. 3, several relative oblique support ribs 15 also are provided on the inside of the aluminum alloy wallboard 1. They can improve the bending resistance, torsion resistance, impact resistance and flatness of the aluminum alloy roof panels and the wall boards, and they can reduce the amount of additional support and fastener inputs and can simplify the assembly of the roof panels and the wall boards.

As shown in FIG. 2, a roof panel's C-shape mounting notch 87 at the bottom of the single aluminum alloy roof panel 8 is convenient to assemble with other items. It can avoid the damage to the roof panel caused by internal fixation. The potholder mat between the built-in fitment and the contact surface of the roof panel creates a cutting bridge to improve the roof panel thermal insulation performance.

Also, as shown in FIG. 3, a wallboard C-shape mounting notch 16 installed on the aluminum alloy wallboard 1 is convenient to assemble with other items. It can avoid the damage to the wallboard caused by internal fixation. The potholder mat between the built-in fitment and the contact surface of the wallboard creates a cutting bridge to improve the roof panel thermal insulation performance.

In conclusion, this invention with the snap-in structure connecting the aluminum alloy wallboard roof panel and corner-connecting materials has relatively better bending resistance, torsion resistance, impact resistance, and overall stability. It reduces or even eliminates the usage of pillars and ring beams and increases room space utilization. As the special connecting structure with the aluminum wallboard, the roof panel and the corner-connecting materials is waterproof, it is not necessary to use waterproof sealed materials at the connection point.

This invention with the snap-in structure connecting the aluminum wallboard, the roof panel, and the corner-connecting materials is primarily applied to install at an aluminum alloy house's wall and roof. The aluminum profiles wallboard, the roof panel, and the corner-connecting materials are designed as a combination of a compact insert-split clasp joint and retaining screws. Under the circumstance that no sealing materials are used, it is waterproof and easy to install.

Certainly, the technicians in this technical field should recognize that the implementation stated above is only used to demonstrate this invention, but not limit this invention. Any change or transform in the spirit of this invention about the above implementation falls into the legal protection scope of this invention as said in the claims.

The invention claimed is:

1. A snap-in structure comprising several single aluminum alloy wallboards, several single aluminum roof panels, and a corner connector, with each single aluminum alloy wallboard comprising an upper wallboard side, a lower wallboard side spaced from the upper wallboard side, and first and second wallboard ends spaced from each other and extending between and interconnected at interconnections to the upper and lower wallboard sides, with a wallboard snap-in groove extending from the upper wallboard side towards and spaced from the lower wallboard side and spaced from the first wallboard end, with a wallboard splicing base formed at the interconnection of the lower wallboard side and the first wallboard end, with the wallboard splicing base including a first wallboard portion and a second wallboard portion, with the first wallboard portion extending from the lower wallboard side towards but spaced from the upper wallboard side and spaced from the first wallboard end, with the second wallboard portion extending from the first wallboard portion spaced from the upper and lower wallboard sides and interconnected to and extending beyond the first wallboard end opposite to the second wallboard end, with a wallboard splicing depression bar extending from the second wallboard end opposite to the first wallboard end, with the wallboard splicing depression bar including a first wallboard segment and a second wallboard segment, with the first wallboard segment extending from the second wallboard end and being spaced from the upper wallboard side, with the second wallboard segment extending from the first wallboard segment and being spaced from the second wallboard end, with a wallboard bulge extending from the second wallboard end and being spaced from the upper wallboard side and the lower wallboard side, with each single aluminum roof panel comprising an upper roof side, a lower roof side spaced from the upper roof side, and first and second roof ends spaced from each other and extending between and interconnected to the upper and lower roof sides, with a roof support section extending from the upper roof side towards and spaced from the lower roof side and spaced from the first roof end, with a roof snap-in groove extending from the first roof side opposite to the second roof side and spaced from the upper and lower roof sides, with a roof splicing base formed at the interconnection of the lower roof side and the first roof end, with the roof splicing base including a first roof portion and a second roof portion, with the first roof portion extending from the lower roof side towards but spaced from the upper roof side and spaced from the first roof end, with the second roof portion extending from the first roof portion spaced from the upper and lower roof sides and interconnected to and terminating in the first roof end, with the roof snap-in groove extending from the first roof end spaced from and intermediate the second roof portion and the upper roof side, with a roof splicing depression bar extending from the second roof end opposite to the first roof end, with the roof splicing depression bar including a first roof segment, a second roof segment, and a third roof segment, with the first roof segment extending from the second roof end spaced from the upper roof side, with the second roof segment extending from the first roof segment spaced from the second roof end, with the third roof segment extending from the first roof segment away from the second roof segment and spaced from and intermediate the second roof end and the second roof segment, with a roof clasp extending from the second roof end spaced from the upper roof side and the lower roof side, with the corner connector including an inner L-shaped side, an outer L-shaped side, and first and second connector ends spaced from each other and extending between and interconnected to the inner and outer L-shaped sides, with the first connector end interconnectable to one of the first and second roof ends, with the second connector end interconnectable to one of the first and second wallboard ends, with the outer L-shaped side including an upper leg and a side leg interconnected to the upper leg, with a corner link groove on the side leg, with the corner link groove comprising first, second, third, fourth and fifth corner segments, with the first corner segment extending from the side leg away from the inner L-shaped side and spaced from the upper leg, with the second corner segment extending from the first corner segment spaced from the side leg and towards the upper leg, with the third corner segment extending from the first corner segment towards but spaced from the upper leg and spaced from and intermediate the second corner segment and the side leg, with the fourth corner segment extending from and interconnected to the third corner segment and spaced from and intermediate the first corner segment and the upper leg, with the fifth corner segment being arcuate in shape, with the fifth corner segment extending from the side leg intermediate and spaced from the first corner segment and the upper leg, and with the fifth corner segment interconnected and terminating in the fourth corner segment spaced from the side leg, with a first corner splicing base formed at the interconnection of the inner L-shaped side and the first corner end, with the first corner splicing base including a first corner portion and a second corner portion, with the first corner portion extending from the inner L-shaped side towards but spaced from the outer L-shaped side and spaced from the first corner end, with the second corner portion extending from the first corner portion spaced from the inner and outer L-shaped sides and interconnected to and terminating in the first corner end, with a corner snap-in groove extending from the outer L-shaped side towards and spaced from the inner L-shaped side and spaced from the second corner end; with a second corner splicing base formed at the interconnection of the inner L-shaped side and the second corner end, with the second corner splicing base including a first corner portion and a second corner portion, with the first corner portion of the second corner splicing base extending from the inner L-shaped side towards but spaced from the outer L-shaped side and spaced from the second corner end, with the second corner portion of the second corner splicing base extending from the first corner portion of the second corner splicing base spaced from the inner and outer L-shaped sides and interconnected to and extending beyond the second corner end opposite to the first corner end, and with a wall extending from the second corner end opposite to the first corner end and spaced from and intermediate the inner and outer L-shaped sides.

2. The snap-in structure of claim 1, with the corner connection further including corner support ribs extending between and interconnected to the inner and outer L-shaped sides and spaced from the first and second corner ends, with the corner support ribs extending at perpendicular angles to the inner and outer L-shaped sides.

3. The snap-in structure of claim 2, with one of the corner support ribs extending contiguously and interconnected to the first corner segment.

4. The snap-in structure of claim 1 further comprising an aluminum alloy surface eave including a first eave end and a second eave end spaced from the first eave end, with the first eave end connected to the corner link groove.

5. A snap-in structure comprising several single aluminum alloy wallboards, several single aluminum roof panels, and a corner connector, with each single aluminum alloy wallboard comprising an upper wallboard side, a lower wallboard side spaced from the upper wallboard side, and first and second wallboard ends spaced from each other and extending between and interconnected at interconnections to the upper and lower wallboard sides, with a wallboard snap-in groove extending from the upper wallboard side towards and spaced from the lower wallboard side and spaced from the first wallboard end, with a wallboard splicing base formed at the interconnection of the lower wallboard side and the first wallboard end, with the wallboard splicing base including a first wallboard portion and a second wallboard portion, with the first wallboard portion extending from the lower wallboard side towards but spaced from the upper wallboard side and spaced from the first wallboard end, with the second wallboard portion extending from the first wallboard portion spaced from the upper and lower wallboard sides and interconnected to and extending beyond the first wallboard end opposite to the second wallboard end, with a wallboard splicing depression bar extending from the second wallboard end opposite to the first wallboard end, with the wallboard splicing depression bar including a first wallboard segment and a second wallboard segment, with the first wallboard segment extending from the second wallboard end and being spaced from the upper wallboard side, with the second wallboard segment extending from the first wallboard segment and being spaced from the second wallboard end, with a wallboard bulge extending from the second wallboard end and being spaced from the upper wallboard side and the lower wallboard side, with each single aluminum roof panel comprising an upper roof side, a lower roof side spaced from the upper roof side, and first and second roof ends spaced from each other and extending between and interconnected to the upper and lower roof sides, with a roof support section extending from the upper roof side towards and spaced from the lower roof side and spaced from the first roof end, with a roof snap-in groove extending from the first roof side opposite to the second roof side and spaced from the upper and lower roof sides, with a roof splicing base formed at the interconnection of the lower roof side and the first roof end, with the roof splicing base including a first roof portion and a second roof portion, with the first roof portion extending from the lower roof side towards but spaced from the upper roof side and spaced from the first roof end, with the second roof portion extending from the first roof portion spaced from the upper and lower roof sides and interconnected to and terminating in the first roof end, with the roof snap-in groove extending from the first roof end spaced from and intermediate the second roof portion and the upper roof side, with a roof splicing depression bar extending from the second roof end opposite to the first roof end, with the roof splicing depression bar including a first roof segment, a second roof segment, and a third roof segment, with the first roof segment extending from the second roof end spaced from the upper roof side, with the second roof segment extending from the first roof segment spaced from the second roof end, with the third roof segment extending from the first roof segment away from the second roof segment and spaced from and intermediate the second roof end and the second roof segment, with a roof clasp extending from the second roof end spaced from the upper roof side and the lower roof side, with the corner connector including an inner L-shaped side, an outer L-shaped side, and first and second connector ends spaced from each other and extending between and interconnected to the inner and outer L-shaped sides, with the first connector end interconnectable to one of the first and second roof ends, with the second connector end interconnectable to one of the first and second wallboard ends, with a first corner splicing base formed at the interconnection of the inner L-shaped side and the first corner end, with the first corner splicing base including a first corner portion and a second corner portion, with the first corner portion extending from the inner L-shaped side towards but spaced from the outer L-shaped side and spaced from the first corner end, with the second corner portion extending from the first corner portion spaced from the inner and outer L-shaped sides and interconnected to and terminating in the first corner end, with a corner snap-in groove extending from the outer L-shaped side towards and spaced from the inner L-shaped side and spaced from the second corner end; with a second corner splicing base formed at the interconnection of the inner L-shaped side and the second corner end, with the second corner splicing base including a first corner portion and a second corner portion, with the first corner portion of the second corner splicing base extending from the inner L-shaped side towards but spaced from the outer L-shaped side and spaced from the second corner end, with the second corner portion of the second corner splicing base extending from the first corner portion of the second corner splicing base spaced from the inner and outer L-shaped sides and interconnected to and extending beyond the second corner end opposite to the first corner end, and with a wall extending from the second corner end opposite to the first corner end and spaced from and intermediate the inner and outer L-shaped sides.

6. The snap-in structure of claim 5, with each single aluminum alloy wallboard further including wallboard support ribs extending between and interconnected to the upper and lower wallboard sides and spaced from the first and second wallboard ends, with the wallboard support ribs extending at non-perpendicular angles to the upper and lower wallboard sides.

7. The snap-in structure of claim 6, with the lower wallboard side including a C-shape wallboard mounting notch, with the wallboard support ribs extending between and interconnected to the upper wallboard side and the C-shape wallboard mounting notch.

8. The snap-in structure of claim 5, with each single aluminum alloy roof panel further including roof support ribs extending between and interconnected to the upper and lower roof sides and spaced from the first and second roof ends, with the roof support ribs extending at non-perpendicular angles to the upper and lower roof sides.

9. The snap-in structure of claim 8, with the lower roof side including a C-shape roof mounting notch, with the roof support ribs extending between and interconnected to the upper roof side and the C-shape roof mounting notch.

10. The snap-in structure of claim 5, with the outer L-shaped side including an upper leg and a side leg interconnected to the upper leg, with a corner link groove on the side leg.

11. A snap-in structure comprising several single aluminum alloy wallboards, several single aluminum roof panels, and a corner connector, with each single aluminum alloy wallboard comprising an upper wallboard side, a lower wallboard side spaced from the upper wallboard side, and first and second wallboard ends spaced from each other and extending between and interconnected at interconnections to the upper and lower wallboard sides, with a wallboard snap-in groove extending from the upper wallboard side towards and spaced from the lower wallboard side and spaced from the first wallboard end, with a wallboard splicing base formed at the interconnection of the lower wallboard side and the first wallboard end, with the wallboard splicing base including a first wallboard portion and a second wallboard portion, with the first wallboard portion extending from the lower wallboard side towards but spaced from the upper wallboard side and spaced from the first wallboard end, with the second wallboard portion extending from the first wallboard portion spaced from the upper and lower wallboard sides and interconnected to and extending beyond the first wallboard end opposite to the second wallboard end, with a wallboard splicing depression bar extending from the second wallboard end opposite to the first wallboard end, with the wallboard splicing depression bar including a first wallboard segment and a second wallboard segment, with the first wallboard segment extending from the second wallboard end and being spaced from the upper wallboard side, with the second wallboard segment extending from the first wallboard segment and being spaced from the second wallboard end, with a wallboard bulge extending from the second wallboard end and being spaced from the upper wallboard side and the lower wallboard side, with each single aluminum roof panel comprising an upper roof side, a lower roof side spaced from the upper roof side, and first and second roof ends spaced from each other and extending between and interconnected to the upper and lower roof sides, with a roof support section extending from the upper roof side towards and spaced from the lower roof side and spaced from the first roof end, with a roof snap-in groove extending from the first roof side opposite to the second roof side and spaced from the upper and lower roof sides, with a roof splicing base formed at the interconnection of the lower roof side and the first roof end, with the roof splicing base including a first roof portion and a second roof portion, with the first roof portion extending from the lower roof side towards but spaced from the upper roof side and spaced from the first roof end, with the second roof portion extending from the first roof portion spaced from the upper and lower roof sides and interconnected to and terminating in the first roof end, with the roof snap-in groove extending from the first roof end spaced from and intermediate the second roof portion and the upper roof side, with a roof splicing depression bar extending from the second roof end opposite to the first roof end, with the roof splicing depression bar including a first roof segment, a second roof segment, and a third roof segment, with the first roof segment extending from the second roof end spaced from the upper roof side, with the second roof segment extending from the first roof segment spaced from the second roof end, with the third roof segment extending from the first roof segment away from the second roof segment and spaced from and intermediate the second roof end and the second roof segment, with a roof clasp extending from the second roof end spaced from the upper roof side and the lower roof side, with the corner connector including an inner L-shaped side, an outer L-shaped side, and first and second connector ends spaced from each other and extending between and interconnected to the inner and outer L-shaped sides, with the first connector end interconnectable to one of the first and second roof ends, with the second connector end interconnectable to one of the first and second wallboard ends, with the outer L-shaped side including an upper leg and a side leg interconnected to the upper leg, with a corner link groove on the side leg, with the corner link groove comprising first, second, third, fourth and fifth corner segments, with the first corner segment extending from the side leg away from the inner L-shaped side and spaced from the upper leg, with the second corner segment extending from the first corner segment spaced from the side leg and towards the upper leg, with the third corner segment extending from the first corner segment towards but spaced from the upper leg and spaced from and intermediate the second corner segment and the side leg, with the fourth corner segment extending from and interconnected to the third corner segment and spaced from and intermediate the first corner segment and the upper leg, with the fifth corner segment being arcuate in shape, with the fifth corner segment extending from the side leg intermediate and spaced from the first corner segment and the upper leg, and with the fifth corner segment interconnected and terminating in the fourth corner segment spaced from the side leg, with a corner splicing depression bar extending from the first corner end opposite to the second corner end, with the corner splicing depression bar including first, second, and third corner segments, with the first corner segment extending from the first corner end spaced from the outer L-shaped side corresponding to the roof splicing base, with the second corner segment extending from the first corner segment spaced from the first corner end, with the third corner segment extending from the first corner segment away from the second corner segment and spaced from and intermediate the first corner end and the second corner segment, with a corner clasp extending from the first corner end spaced from the outer L-shaped side corresponding to the roof support section and spaced from the inner L-shaped side and spaced from the first corner end, with a corner snap-in groove extending from the outer L-shaped side towards and spaced from the inner L-shaped side and spaced from the second corner end, with a corner splicing base formed at the interconnection of the inner L-shaped side and the second corner end, with the corner splicing base including a first corner portion extending from the inner L-shaped side towards but spaced from the outer L-shaped side and spaced from the second corner end, with the second corner portion extending from the first corner portion spaced from the inner and outer L-shaped sides and interconnected to and extending beyond the second corner end opposite to the first corner end.

12. The snap-in structure of claim 11, with the corner connection further including corner support ribs extending between and interconnected to the inner and outer L-shaped sides and spaced from the first and second corner ends, with the corner support ribs extending at perpendicular angles to the inner and outer L-shaped sides.

13. The snap-in structure of claim 12, with one of the corner support ribs extending contiguously and interconnected to the first corner segment.

14. A snap-in structure comprising several single aluminum alloy wallboards, several single aluminum roof panels, and a corner connector, with each single aluminum alloy wallboard comprising an upper wallboard side, a lower wallboard side spaced from the upper wallboard side, and first and second wallboard ends spaced from each other and extending between and interconnected at interconnections to the upper and lower wallboard sides, with a wallboard snap-in groove extending from the upper wallboard side towards and spaced from the lower wallboard side and spaced from the first wallboard end, with a wallboard splicing base formed at the interconnection of the lower wallboard side and the first wallboard end, with the wallboard splicing base including a first wallboard portion and a second wallboard portion, with the first wallboard portion extending from the lower wallboard side towards but spaced from the upper wallboard side and spaced from the first wallboard end, with the second wallboard portion extending from the first wallboard portion spaced from the upper and lower wallboard sides and interconnected to and extending beyond the first wallboard end opposite to the second wallboard end, with a wallboard splicing depression bar extending from the second wallboard end opposite to the first wallboard end, with the wallboard splicing depression bar including a first wallboard segment and a second wallboard segment, with the first wallboard segment extending from the second wallboard end and being spaced from the upper wallboard side, with the second wallboard segment extending from the first wallboard segment and being spaced from the second wallboard end, with a wallboard bulge extending from the second wallboard end and being spaced from the upper wallboard side and the lower wallboard side, with each single aluminum roof panel comprising an upper roof side, a lower roof side spaced from the upper roof side, and first and second roof ends spaced from each other and extending between and interconnected to the upper and lower roof sides, with a roof support section extending from the upper roof side towards and spaced from the lower roof side and spaced from the first roof end, with a roof snap-in groove extending from the first roof side opposite to the second roof side and spaced from the upper and lower roof sides, with a roof splicing base formed at the interconnection of the lower roof side and the first roof end, with the roof splicing base including a first roof portion and a second roof portion, with the first roof portion extending from the lower roof side towards but spaced from the upper roof side and spaced from the first roof end, with the second roof portion extending from the first roof portion spaced from the upper and lower roof sides and interconnected to and terminating in the first roof end, with the roof snap-in groove extending from the first roof end spaced from and intermediate the second roof portion and the upper roof side, with a roof splicing depression bar extending from the second roof end opposite to the first roof end, with the roof splicing depression bar including a first roof segment, a second roof segment, and a third roof segment, with the first roof segment extending from the second roof end spaced from the upper roof side, with the second roof segment extending from the first roof segment spaced from the second roof end, with the third roof segment extending from the first roof segment away from the second roof segment and spaced from and intermediate the second roof end and the second roof segment, with a roof clasp extending from the second roof end spaced from the upper roof side and the lower roof side, with the corner connector including an inner L-shaped side, an outer L-shaped side, and first and second connector ends spaced from each other and extending between and interconnected to the inner and outer L-shaped sides, with the first connector end interconnectable to one of the first and second roof ends, with the second connector end interconnectable to one of the first and second wallboard ends, with a corner splicing depression bar extending from the first corner end opposite to the second corner end, with the corner splicing depression bar including first, second, and third corner segments, with the first corner segment extending from the first corner end spaced from the outer L-shaped side corresponding to the roof splicing base, with the second corner segment extending from the first corner segment spaced from the first corner end, with the third corner segment extending from the first corner segment away from the second corner segment and spaced from and intermediate the first corner end and the second corner segment, with a corner clasp extending from the first corner end spaced from the outer L-shaped side corresponding to the roof support section and spaced from the inner L-shaped side and spaced from the first corner end, with a corner snap-in groove extending from the outer L-shaped side towards and spaced from the inner L-shaped side and spaced from the second corner end, with a corner splicing base formed at the interconnection of the inner L-shaped side and the second corner end, with the corner splicing base including a first corner portion extending from the inner L-shaped side towards but spaced from the outer L-shaped side and spaced from the second corner end, with the second corner portion extending from the first corner portion spaced from the inner and outer L-shaped sides and interconnected to and extending beyond the second corner end opposite to the first corner end.

15. A snap-in structure comprising several single aluminum alloy wallboards, several single aluminum roof panels, a corner connector and an aluminum alloy surface eave, with each single aluminum alloy wallboard comprising an upper wallboard side, a lower wallboard side spaced from the upper wallboard side, and first and second wallboard ends spaced from each other and extending between and interconnected at interconnections to the upper and lower wallboard sides, with a wallboard snap-in groove extending from the upper wallboard side towards and spaced from the lower wallboard side and spaced from the first wallboard end, with a wallboard splicing base formed at the interconnection of the lower wallboard side and the first wallboard end, with the wallboard splicing base including a first wallboard portion and a second wallboard portion, with the first wallboard portion extending from the lower wallboard side towards but spaced from the upper wallboard side and spaced from the first wallboard end, with the second wallboard portion extending from the first wallboard portion spaced from the upper and lower wallboard sides and interconnected to and extending beyond the first wallboard end opposite to the second wallboard end, with a wallboard splicing depression bar extending from the second wallboard end opposite to the first wallboard end, with the wallboard splicing depression bar including a first wallboard segment and a second wallboard segment, with the first wallboard segment extending from the second wallboard end and being spaced from the upper wallboard side, with the second wallboard segment extending from the first wallboard segment and being spaced from the second wallboard end, with a wallboard bulge extending from the second wallboard end and being spaced from the upper wallboard side and the lower wallboard side, with each single aluminum roof panel comprising an upper roof side, a lower roof side spaced from the upper roof side, and first and second roof ends spaced from each other and extending between and interconnected to the upper and lower roof sides, with a roof support section extending from the upper roof side towards and spaced from the lower roof side and spaced from the first roof end, with a roof snap-in groove extending from the first roof side opposite to the second roof side and spaced from the upper and lower roof sides, with a roof splicing base formed at the interconnection of the lower roof side and the first roof end, with the roof splicing base including a first roof portion and a second roof portion, with the first roof portion extending from the lower roof side towards but spaced from the upper roof side and spaced from the first roof end, with the second roof portion extending from the first roof portion spaced from the upper and lower roof sides and interconnected to and terminating in the first roof end, with the roof snap-in groove extending from the first roof end spaced from and intermediate the second roof portion and the upper roof side, with a roof splicing depression bar extending from the second roof end opposite to the first roof end, with the roof splicing depression bar including a first roof segment, a second roof segment, and a third roof segment, with the first roof segment extending from the second roof end spaced from the upper roof side, with the second roof segment extending from the first roof segment spaced from the second roof end, with the third roof segment extending from the first roof segment away from the second roof segment and spaced from and intermediate the second roof end and the second roof segment, with a roof clasp extending from the second roof end spaced from the upper roof side and the lower roof side, with the corner connector including an inner L-shaped side, an outer L-shaped side, and first and second connector ends spaced from each other and extending between and interconnected to the inner and outer L-shaped sides, with the first connector end interconnectable to one of the first and second roof ends, with the second connector end interconnectable to one of the first and second wallboard ends, with the outer L-shaped side including an upper leg and a side leg interconnected to the upper leg, with a corner link groove on the side leg, with the corner link groove comprising a first corner segment extending from the side leg away from the inner L-shaped side and spaced from the upper leg, a second corner segment extending from the first corner segment spaced from the side leg and towards the upper leg, a third corner segment extending from the first corner segment towards but spaced from the upper leg and spaced from and intermediate the second corner segment and the side leg, a fourth corner segment extending from and interconnected to the third corner segment and spaced from and intermediate the first corner segment and the upper leg, and a fifth corner segment being arcuate in shape, extending from the side leg intermediate and spaced from the first corner segment and the upper leg, and interconnected and terminating in the fourth corner segment spaced from the side leg, with the aluminum alloy surface eave including a first eave end and a second eave end spaced from the first eave end, with the first eave end connected to the corner link groove, wherein the first eave end includes an eave clasp and eave upper and lower arms, with the eave clasp extending from the first eave end opposite to the second eave end, with the eave clasp receivable in the corner link groove, with the eave upper arm slideable on the fifth corner segment, with the eave lower arm spaced from the eave upper arm and abutable with the outer L-shaped side, and with the eave clasp spaced from and intermediate the upper and lower eave arms.

16. The snap-in structure of claim 15, wherein the aluminum alloy surface eave includes an eave C-shaped mounting notch configured to assemble items and located on a bottom surface intermediate and spaced from the first and second eave ends.

* * * * *